United States Patent [19]

Kennedy

[11] Patent Number: 4,631,046

[45] Date of Patent: Dec. 23, 1986

[54] BAKE IN TRAY AND METHOD OF FORMING A BLANK FOR THE SAME

[75] Inventor: Kenneth V. Kennedy, Little Canada, Minn.

[73] Assignee: Waldorf Corporation, St. Paul, Minn.

[21] Appl. No.: 703,184

[22] Filed: Feb. 19, 1985

Related U.S. Application Data

[60] Continuation of Ser. No. 628,584, Aug. 23, 1984, abandoned, which is a division of Ser. No. 540,107, Oct. 11, 1983, abandoned, which is a continuation of Ser. No. 347,711, Feb. 10, 1982, abandoned.

[51] Int. Cl.[4] ..... B31B 3/20; B31B 9/26; B32B 23/08

[52] U.S. Cl. ..... 493/59; 493/63; 493/148; 493/355; 428/35; 428/511

[58] Field of Search ..... 493/59, 148, 149, 60, 493/61, 62, 63, 354, 355, 342, 363; 428/35, 342, 511

[56] References Cited

U.S. PATENT DOCUMENTS

| | | | |
|---|---|---|---|
| 3,449,257 | 6/1969 | Tuite et al. | 428/511 |
| 3,469,737 | 9/1969 | Forrer | 493/59 |
| 3,645,822 | 2/1972 | Widiger | 229/31 R |
| 4,019,675 | 4/1977 | Andersson | 229/31 R |
| 4,177,715 | 12/1979 | Meyers | 493/59 |
| 4,308,985 | 1/1982 | Manizza et al. | 229/31 R |
| 4,351,473 | 9/1982 | Manizza | 229/43 |
| 4,421,825 | 12/1983 | Seiter | 428/332 |

*Primary Examiner*—Francis S. Husar
*Assistant Examiner*—William E. Terrell
*Attorney, Agent, or Firm*—Evelyn M. Sommer

[57] ABSTRACT

A folded paperboard tray suitable for cooking food products contained in the tray in a microwave oven has an interior surface which is coated with a styrene methyl methacrylate copolymer to prevent liquid seepage from the food product through the paperboard. The tray has a peripheral flange formed thereon which is connected to the remainder of the tray by means of a cut score fold line. The use of the cut score fold line prevents the copolymer coating on the tray from tearing away from the edges of the tray when the edges are cut from a stock sheet of coated paperboard.

2 Claims, 3 Drawing Figures

BAKE IN TRAY AND METHOD OF FORMING A BLANK FOR THE SAME

This is a continuation of application Ser. No. 628,584, filed Aug. 23, 1984, now abandoned, which is a division of prior Ser. No. 540,107 filed Oct. 11, 1983, now abandoned, which is a continuation of prior application Ser. No. 347,711 filed Feb. 10, 1982, now abandoned.

This invention relates to a folded paperboard bake in tray and a method of forming a blank from which the tray is formed. The tray is provided with an internal coating of an acrylic copolymer which moisture proofs the tray so that liquids from a food product being cooked in the tray will not seep into the paperboard.

Plastic coated paperboard trays have been used for holding various food products, with the plastic coating on the paperboard being operative to prevent seepage of moisture from the food products into the paperboard.

This invention relates to an improved folded paperboard tray which has an internal coating of plastic material, which tray is adapted for containing a food product while the latter is being cooked in situ in a microwave oven. The tray of this invention has its interior surface coated with a styrene methyl methacrylate copolymer to render the tray moisture proof so that moisture from the food product will not seep into the paperboard material from which the tray is formed. The tray is provided with a peripheral flange which is foldably connected to the remainder of the tray to serve as a finger gripping means for lifting the tray after the food product has been cooked in the tray whereby the food product will not come into contact with the finers of one handling the tray, and whereby the fingers of the person handling the tray will not be subjected to the heat of the cooked food product in the tray.

The tray of this invention is formed from a scored and cut blank which, in turn, is formed from pre-coated paperboard stock. The styrene methyl methacrylate copolymer coating is admirably suited for moisture proofing the paperboard, but, at the same time, is a relatively brittle coating which can create problems when the blank is formed from the coated paperboard stock. The brittleness of the copolymer coating was discovered to be causing the coating to tear away from he edges of the blank when the edges were cut from the coated paperboard stock. The tearing was occurring at the outer edges of the flanges which were formed on the blank by score fold lines concurrently with the edge cutting operation. I have discovered that this tearing can be eliminated by forming an interrupted cut score fold line connecting the flanges to the remainder of the tray blank. Thus, I have discovered that by using an interrupted cut score fold line, rather than a conventional score fold line, the edges of the coated paperboard blank can be cut without the coating cracking, tearing or peeling away from the paperboard.

It is, therefore, an object of this invention to provide an improved folded plastic coated paperboard tray which can be formed with a peripheral flange connected to the remainder of the tray by a fold line.

It is a further object of this invention to provide a tray of the character described which is coated with a relatively brittle styrene methyl methacrylate copolymer plastic.

It is an additional object of this invention to provide a tray of the character described wherein the peripheral flange is connected to the remainder of the tray by means of an interrupted cut score line which prevents the plastic coating from releasing from the edges of the tray when the coated paperboard stock is cut to form a blank for the tray.

It is yet another object of this invention to provide a method of making the blank from which the tray of the character described is formed.

These and other objects and advantages of the invention will become more readily apparent from the following detailed disclosure of a preferred embodiment of the invention taken in conjunction with the accompanying drawings, in which.

Figure 1:
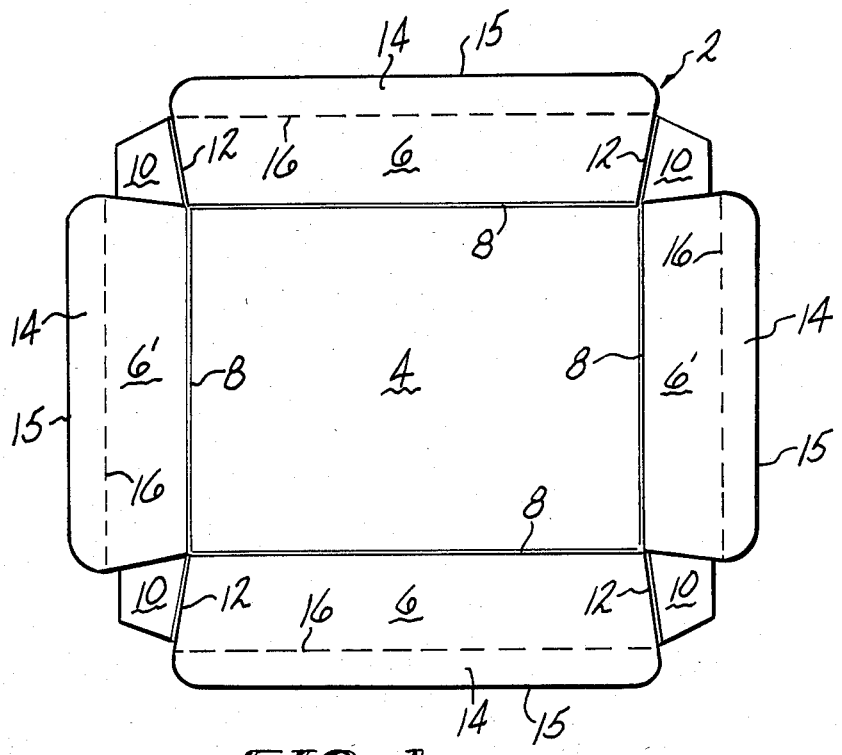
FIG. 1 is a plan view of a preferred embodiment of a blank which has been cut and scored from a stock supply of precoated paperboard and from which the tray of this invention is formed.

Referring now to the drawings, there is shown in FIG. 1 a preferred embodiment of a blank denoted generally by the numeral 2 which blank 2 has been scored and cut from a precoated stock supply of paperboard. The surface of the blank 2 facing the viewer is the inside surface of the tray when erected and is coated with a moisture resistant coating of a styrene methyl methacrylate copolymer plastic. The blank 2 includes a central bottom wall 4 and four side walls 6 and 6' connected to edges of the bottom wall 4 by conventional score fold lines 8. Two of the side walls 6 are provided with glue flaps 10 which are foldably connected to opposite ends of the side walls 6 by conventional score fold lines 12. The glue flaps 10 in the blank 2 are free of connections with the intervening side walls 6'. Connected to the outer margin of each side wall 6 and 6' there is disposed a finger grasping flange 14. Each flange 14 is connected to its respective side wall 6 and 6' by means of an interrupted cut score fold line 16. The blank 2 has its fold lines, cut lines, and outer edges all formed and cut at the same time. By forming the fold lines 16 as interrupted cut score fold lines, the tendency of the plastic coating to delaminate at the outer cut edges 15 of the flanges 14 during the simultaneous cutting and scoring operation is eliminated and smooth consistant edges are formed on the blank 2 with no delamination. Such has been found not to be the case were the fold lines 16 conventional score fold lines, as are the other fold lines 8 and 12.

Figure 2:
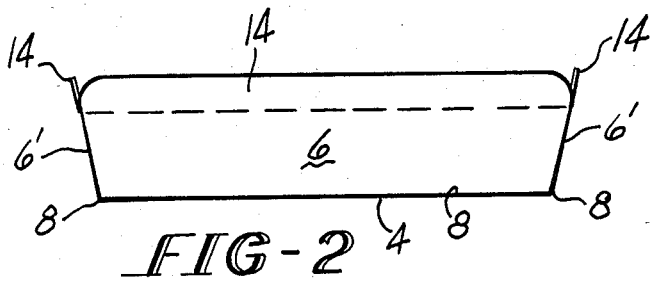
FIG. 2 is a side elevational view of a tray formed by folding and glueing the blank of FIG. 1.
Figure 3:
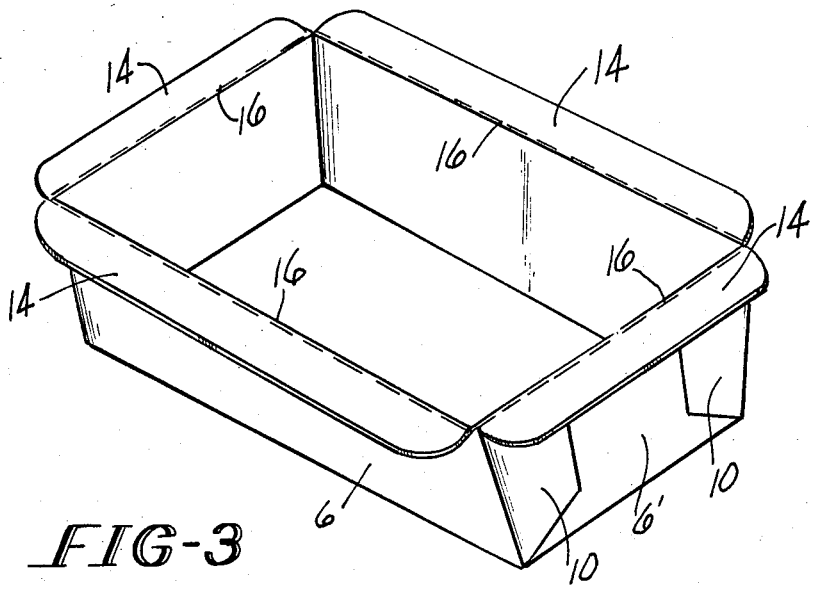
FIG. 3 is a perspective view of the tray of FIG. 2 showing the flanges of the tray folded down to their finger gripping positions so that the tray can be safely handled when filled with hot food that has been cooked in situ in the tray.

The blank 2 is erected into the tray shown in FIGS. 2 and 3 by folding the side walls 6 and 6' upward about the fold lines 8 and overlapping the glue flaps 10 on the outer surface of the side walls 6' The glue flaps 10 are glued to the side walls 6' to retain the tray in its erected form as shown in FIG. 3.

The food products to be cooked in the microwave oven are packaged in the tray with the flanges in the upwardly extending position shown in FIG. 2. When handling of the tray is necessary, as after the food products have been cooked, the flanges 14 are folded outwardly about the fold lines 16 whereby the tray can be readily manually grasped without subjecting the fingers to the heat of the cooked product, and without the likelihood of touching the cooked product with the fingers.

It will be readily appreciated that the tray of this invention will provide a suitable moisture proof vessel for microwave cooking of food products. The provision of the flanges with the interrupted cut score fold line connections allows the tray to be coated with the relatively brittle styrene methyl methacrylate copolymer plastic, which provides superior moisture penetration resistance, while preventing edge delamination of the coating. Using the interrupted cut score fold lines allows the blank to be cut and scored in one simultaneous operation without the risk of undesirable edge delamination of the coating.

Since many changes and variations of the disclosed embodiments of the invention may be made without departing from the inventive concept, it is not intended to limit the invention otherwise than as required by the appended claims.

What is claimed is:

1. A method of forming a blank from which a paperboard microwave cooking tray can be erected, said method comprising the steps of:

(a) providing a supply of stock paperboard one side of which is coated with a moisture resistant styrene methyl methacrylate copolymer coating;

(b) forming a plurality of score lines on said coated paperboard thereby defining a bottom wall and four side walls connected to said bottom wall by said score lines;

(c) simultaneously with the formation of said plurality of score lines, forming a plurality of interrupted cut score fold lines thereby defining foldable connections and a plurality of flanges which are foldably connected to said side walls, the cuts of said interrupted cut score lines passing through the paperboard as well as its coating; and (d) simultaneously with the formation of said plurality of score lines and the formation of said plurality of interrupted cut score fold lines, cutting said coated paperboard to form the periphery of said blank and separate said blank from said supply of stock paperboard.

2. The method according to claim 1 further comprising the steps of:

folding the four side walls about said score lines to an angular position relative to said bottom wall, thereby forming said cooking tray; and folding said flanges outwardly about said interrupted cut score lines relative to said tray, thereby forming outwardly extending projections on said tray.

* * * * *